US009731301B2

(12) United States Patent
Sato et al.

(10) Patent No.: US 9,731,301 B2
(45) Date of Patent: Aug. 15, 2017

(54) SWING ROTOR WITH HOLDING PINS FIXED TO BRANCH ARMS AND HAVING CONNECTION PART CONNECTING THE BRANCH ARMS FOR CENTRIFUGE AND CENTRIFUGE

(71) Applicant: Hitachi Koki Co.,Ltd., Tokyo (JP)

(72) Inventors: Jun Sato, Ibaraki (JP); Kenichi Nemoto, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 14/925,989

(22) Filed: Oct. 29, 2015

(65) Prior Publication Data

US 2016/0121342 A1 May 5, 2016

(30) Foreign Application Priority Data

Oct. 30, 2014 (JP) ..... 2014-220926

(51) Int. Cl.
*B04B 5/04* (2006.01)

(52) U.S. Cl.
CPC ..... *B04B 5/0421* (2013.01)

(58) Field of Classification Search
CPC ..... B04B 5/0421
USPC ..... 494/16–21, 12, 31, 33, 43, 81; 422/548
See application file for complete search history.

(56) References Cited

U.S. PATENT DOCUMENTS 3,873,021 A * 3/1975 Paulsen ..... B04B 5/0421 494/20
8,469,870 B2 * 6/2013 Nemoto ..... B04B 5/0421 494/20
2012/0190527 A1 * 7/2012 Nemoto ..... B04B 5/0421 494/33
2016/0121342 A1 * 5/2016 Sato ..... B04B 5/0421 494/31

FOREIGN PATENT DOCUMENTS

DE 3917855 C1 * 7/1990 ..... B04B 5/0421
DE 4314846 A1 * 11/1994 ..... B04B 5/0421
JP 2012-101203 5/2012

* cited by examiner

*Primary Examiner* — Charles Cooley
(74) *Attorney, Agent, or Firm* — Jianq Chyun IP Office

(57) ABSTRACT

Provided is a swing rotor for a centrifuge. The centrifuge includes a swing type rotor body having a plurality of holding pins and a plurality of buckets held by the holding pins in a swingable manner. On the rotor body, a connection part is formed to connect two branch arms that diverge from an arm part on an outer peripheral side. A thickness-reduced part penetrating in the same direction as a driving shaft is formed in a region surrounded by the two branch arms on an inner peripheral side of the connection part. Since the branch arms deform accordingly to a certain extent, partial concentration of the stress applied on the holding pins due to a centrifugal load can be alleviated. Thus, the lifespan of the centrifuge can be improved and the centrifugal separation operation can be stabilized.

10 Claims, 12 Drawing Sheets

SWING ROTOR WITH HOLDING PINS FIXED TO BRANCH ARMS AND HAVING CONNECTION PART CONNECTING THE BRANCH ARMS FOR CENTRIFUGE AND CENTRIFUGE

CROSS-REFERENCE TO RELATED APPLICATION

This application claims the priority benefit of Japan application serial no. 2014-220926, filed on Oct. 30, 2014. The entirety of the above-mentioned patent application is hereby incorporated by reference herein and made a part of this specification.

BACKGROUND OF THE INVENTION

Field of the Invention

The invention relates to a swing rotor type centrifuge (centrifugal separator) used for separating a sample in the fields of medicine, pharmacy, genetic engineering, biotechnology, and so on, and particularly relates to an improvement in the shape of a swing rotor that holds swinging buckets.

Description of Related Art

A centrifugal separator is a device, which includes a rotor capable of accommodating a plurality of sample containers filled with samples therein and a driving means, such as a motor, rotationally driving the rotor and rotates the rotor in a rotor chamber to apply a centrifugal force so as to centrifugally separate the samples. A swing rotor for centrifuge is a device for rotating buckets, which accommodate sample containers having a bottomed part and filled with samples therein, in a state of holding the buckets swingable with respect to the swing rotor body. A centrifugal load of the bucket is held by a set of holding pins (convex parts) disposed on opposite surfaces of arms of the swing rotor body. Concave parts are formed on two side surfaces of the bucket to engage with the cylindrical surfaces on the outer peripheral side of the holding pins of the swing rotor body, and the concave parts are hung downward from the top of the holding pins and are held by the holding pins in a slidable manner. A gap that does not interfere with the sliding exists between the front end surfaces of the holding pins and the opposite surfaces of the concave parts of the bucket (orthogonal plane). In terms of the positional relationship, the central axis of the bucket and the driving shaft of the motor are parallel to each other (swing angle $\theta=0°$) when the rotor is stationary. However, as the rotation speed of the rotor increases, the bucket swings due to the centrifugal force. The bucket rotates around the swing axis so that $\theta>0°$, and then enters a substantially horizontal state ($\theta\approx90°$) when a rotation speed that is sufficient for generating a centrifugal force to make the bucket horizontal is reached. Thereafter, the centrifugal separation operation ends, and the swing angle $\theta$ decreases as the rotation speed drops and becomes 0° ($\theta=0°$) when the rotation of the rotor stops. Thus, the relative angle between the central axis of the bucket and the driving shaft of the swing rotor changes according to the centrifugal force during the centrifugation.

The load of the bucket, the sample, and the sample container during the centrifugation is held by the convex parts (holding pins) that are disposed to face each other on the swing rotor body. When the swing rotor body rotates at a high speed, the holding pins are slightly deformed by the centrifugal force they receive from the bucket, and particularly stress is concentrated near the bases of the convex parts. For this reason, various measures have been considered in order to prevent the stress from concentrating on a particular portion of the holding pins. According to Japanese Patent Publication No. 2012-101203, for example, the holding pin 25 has a shape that is narrowed down to reduce the outer diameter on the aim side, and the diameter of the sliding surface in contact with the pin receiving part of the bucket is increased, and a narrowed shape is formed on the front end side of the sliding surface, so as to prevent the stress received by the holding pins from concentrating on a particular portion while maintaining the contact area of the bucket and the holding pins at a certain level.

PRIOR ART LITERATURE

Patent Literature

Patent Literature 1: Japanese Patent Publication No. 2012-101203

SUMMARY OF THE INVENTION

Problem to be Solved

In the rotor, a pair of opposite convex parts (holding pins) is disposed to face each other to support the bucket in a swingable manner, and concave parts are formed on the side surfaces of the bucket to engage with the cylindrical surfaces of the convex parts. The concave parts of the bucket swing with respect to the convex parts, so as to swing the bucket to the horizontal. A reinforcing part is disposed around the concave part of the bucket, and through improvement of the shape near the convex parts and the sliding surface on the side of the rotor body, in recent years, the tendency is to further increase the capacity of the bucket so as to process a large amount of sample at one time. Under the circumstances, the amount of the sample contained in the bucket increases, and correspondingly the size of the bucket also increases, which inevitably increases the weight. When the weight increases, the centrifugal load applied to the holding pin will also increase, and stress concentration greater than before will occur near the base of the convex part of the holding pin of the rotor body and increase the deformation amount. Traditionally, improvements have been made to the shape of the holding pin or the curvature radius of the junction between the holding pin and the arm to suppress deformation of the convex part of the rotor so as to reduce the stress. However, in the case of further increasing the size of the bucket, the following problem occurs. That is, due to the increase of the centrifugal load, the conventional reinforcing part cannot cope with the stress. It is conceivable to use aluminum alloy or stainless steel which is widely used as the material of the rotor or the bucket, or titanium alloy which is a light and high-strength material. Nevertheless, because titanium alloy is expensive and difficult to machine, the manufacturing costs will rise significantly. Considering the design of the attachment structure of the holding pin as well as modifying the shape of the arm side that fixes the holding pin, the inventors accomplished the invention.

In view of the above, the invention provides a centrifuge and a swing rotor for the centrifuge for reducing the stress concentrating near the base of the convex holding pin, making it possible to increase the capacity of the bucket that can be installed and suppress reduction in the lifespan of the swing type rotor body.

The invention further provides a centrifuge and a swing rotor for the centrifuge for keeping the gap between the convex (cylindrical) holding pin and the bucket as uniform as possible during the centrifugal separation operation and avoiding causing unnecessary vibration to the sample, so as to stabilize the centrifugal separation operation.

Solution to the Problem

According to a feature of the invention, a centrifuge includes a driving shaft rotated by a driving means, a swing type rotor body installed on the driving shaft, a plurality of holding pins disposed on the rotor body, and a plurality of buckets hung on the holding pins in a swingable manner. The rotor body includes a plurality of arm parts extending outward in a radial direction from a rotation center and a plurality of branch arms diverging at a front end of each of the arm parts on an outer peripheral side to be separated by a predetermined angle. The holding pins are fixed to the branch arms, and a connection part is configured to connect two of the branch arms that diverge from the arm parts on the outer peripheral side. A thickness-reduced part penetrating in the same direction as a rotation axis of the rotor body is configured in a region surrounded by the two branch arms on an inner peripheral side of the connection part. The holding pins are protrusions formed integrally with the rotor body and each have a cylindrical surface, and boundary portions between the branch arms and the holding pins are connected by curved surfaces. Thus, the through thickness-reduced part is disposed while the outer peripheral side of the branch arm is held by an arc portion or a bow. Thereby, the branch arm deforms in a state substantially perpendicular to the holding pin, such that the stress concentration near the convex part base of the holding pin can be alleviated.

According to another feature of the invention, a space (bucket accommodating part) between a set of the holding pins formed on the branch arms that extend from two adjacent arm parts of the arm parts to face the held bucket is an open structure without the connection part on the outer peripheral side. The connection part has a cylindrical or prismatic shape, which is curved or straight, and is disposed such that a longitudinal axis of the connection part is located on an outer side in the radial direction with respect to an intersection point of a central axis of one of the holding pins and one of the branch arms connected to the one of the holding pins. In this case, the thickness-reduced part has a shape similar to an outer edge shape of the branch arms and the connection part when viewed from above, or has a shape, e.g. circle or inverted triangle, not similar to the outer edge shape.

According to another feature of the invention, it is preferable that a circumferential thickness of the branch arm is smaller than a radial thickness of the connection part. In addition, a minimum distance $r_2$ from the rotation center of the rotor body to the connection part is equal to or greater than a minimum distance $r_1$ from the rotation center of the rotor body to the cylindrical surface of each of the holding pins. With such a configuration, if the thickness of the arc portion or the bow is increased and the thickness of the branch arm formed at the front end of the arm part is reduced, excessive deformation of the branch arm can be prevented.

Effects of the Invention

According to the invention, by forming a substantially triangular, circular, or substantially inverted triangular through thickness-reduced part in the substantially fan-shaped or substantially triangular bucket holding part which is formed at the front end of the arm part of the rotor, the branch arm is allowed to deform independently. Consequently, the deformation resulting from the centrifugal load applied on the convex part of the holding pin can be alleviated to reduce the stress concentrated near the base of the holding pin. Further, the lifespan of the swing type rotor body, which may be shortened easily due to stress concentration, can be improved and a highly safe centrifuge can be provided.

DESCRIPTION OF THE EMBODIMENTS

Embodiment 1

Figure 1:
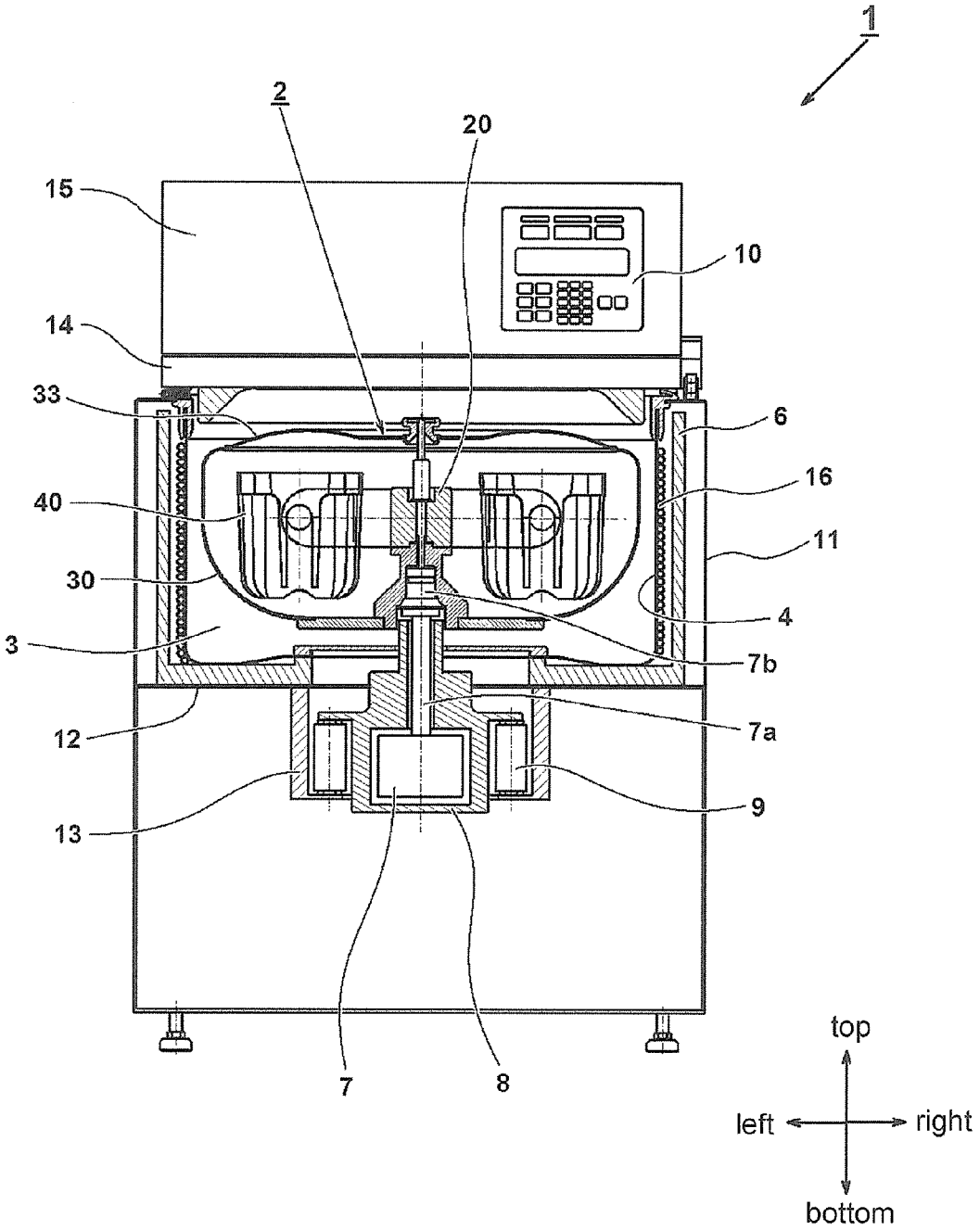
FIG. 1 is a front view of the centrifuge according to the invention and shows the main portions in cross-section.

Hereinafter, embodiments of the invention are described with reference to the figures. In the figures below, the same parts are assigned with the same reference numerals, and repeated descriptions will be omitted. Moreover, in this specification, terms such as front, rear, left, right, top, bottom, inner peripheral side, and outer peripheral side refer to the directions shown in the figures. The numerical values mentioned hereinafter also cover cases of substantially the same values. In addition, where a positional relationship, such as parallel, orthogonal, planar, and opposite, is mentioned, it may refer not only to completely parallel, completely orthogonal, completely planar, and completely opposite, but also to substantially parallel, substantially orthogonal, substantially planar, and substantially opposite.

FIG. 1 is a longitudinal cross-sectional view of a centrifuge 1 of the invention. The centrifuge 1 includes a box-shaped case 11 and is partitioned into an upper space and a lower space by a partition plate 12 near a vertical center of the interior of the case 11. A substantially cylindrical bowl 4 with an open top side is accommodated in the upper space of the partition plate 12, and a protective wall 6 is disposed on the outer peripheral side of the bowl 4. The top side of the bowl 4 is sealed by an openable door 14, by which a rotor chamber 3 is formed. A freezing pipe 16 is wound around the bowl 4, and the interior of the rotor chamber 3 is maintained at a desired temperature by a cooling device (not shown). A rotor assembly 2 is installed in the rotor chamber 3. The rotor assembly 2 is an assembly of a swing rotor and an accommodating cover 30 that accommodates the swing rotor. In this embodiment, the swing rotor rotates in a state where the swing rotor is accommodated in the accommodating cover 30. The swing rotor includes a rotor body 20 installed on a driving shaft 7*a* and a plurality of buckets 40 held swingable with respect to the rotor body 20. In the conventional swing rotor type centrifuge, the swing rotor is rotated in a state without the accommodating cover 30. In the invention, the centrifugation operation may also be carried out without using the accommodating cover 30. Use of the accommodating cover 30 is not necessary to the invention.

In the lower space partitioned by the partition plate 12 in the case 11, a motor 7 serving as the driving means is accommodated in a housing 8. The housing 8 is fixed to an attaching member 13 toward the partition plate 12 through a damper rubber 9. The motor 7 is disposed such that the driving shaft 7*a* of the motor 7 extends in the vertical direction. The driving shaft 7*a* extends from a through hole formed at the bottom of the bowl 4 to reach into the interior space of the rotor chamber 3. A crown 7*b* for transmitting a rotation torque of the driving shaft 7*a* is disposed on an upper end part of the driving shaft 7*a* and the rotor assembly 2 is held by the crown 7*b*. By rotating the rotor assembly 2 at a high speed, the buckets 40 are swung around the swing axis by the centrifugal force. It is possible to remove the rotor assembly 2 from the rotor chamber 3 to the outside in such an assembly state. Also, in a state where the rotor assembly 2 is set in the centrifuge 1, a lid 33 of the accommodating cover 30 can be removed for removing the buckets 40.

An operation display section 10 is disposed on an inclined panel 15 on the upper rear side of the case 11. The operation display section 10 is provided to achieve functions of an input part and a display part, wherein the input part is for receiving input from the user and the display part displays information to the user. The operation display section 10 can be made up by a plurality of buttons and a LED display device, or be configured using a touch type liquid crystal display. Though not shown in FIG. 1, a controller (not shown) is provided for performing the overall control of the centrifuge 1, such as control of display of information to the operation display section 10 and receipt of operation input from the user, control of rotation of the motor 7, control of the cooling device (not shown) for supplying a refrigerant to the freezing pipe 16, and so on. The controller is an electronic circuit including a microcomputer, volatile and non-volatile storage memories, and so on.

Figure 2:
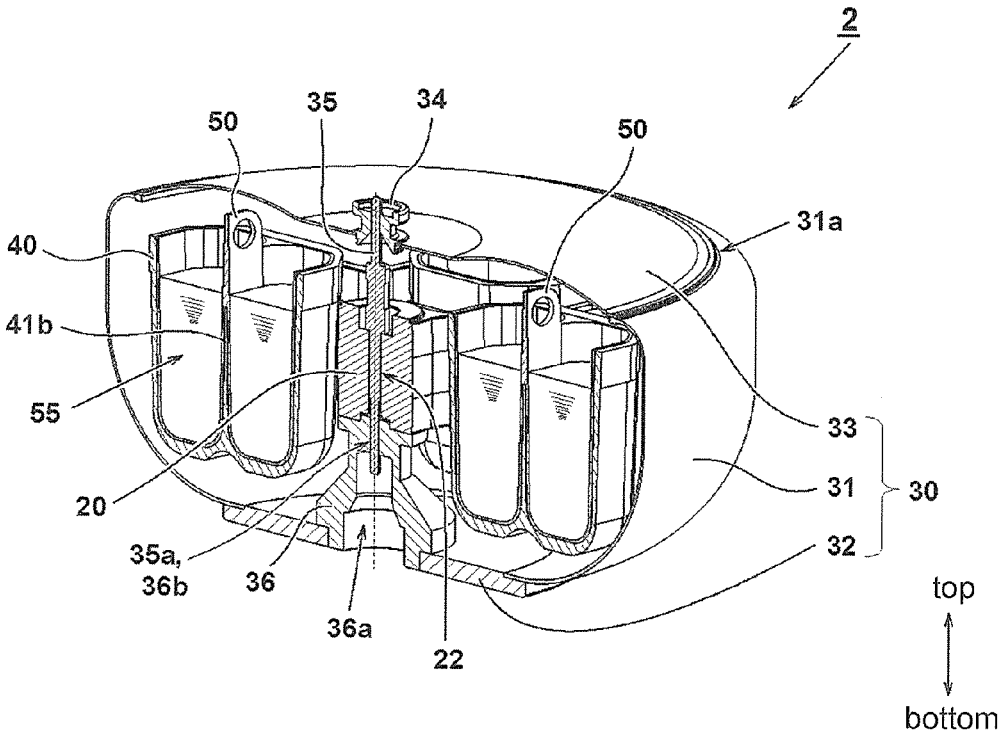
FIG. 2 is a perspective cross-sectional view of the rotor assembly 2 of the centrifuge 1 according to an embodiment of the invention.

FIG. 2 is a perspective cross-sectional view of the rotor assembly 2 of the centrifuge 1 according to an embodiment of the invention. The rotor assembly 2 is an assembly that accommodates the rotor body 20 (the rotor body 20 also includes a coupling 36 attached by a screw), to which a plurality of buckets 40 are set, in the interior of the accommodating cover 30. The accommodating cover 30 includes a shell 31, a base 32, and the lid 33. FIG. 2 illustrates a state where the sample containers 50 with the buckets 40 filled with a sample 55 are installed. The bucket 40 has an inner wall shape adapted to the outer shape of the sample container 50 and is manufactured by integrally molding or machining an aluminum alloy. The accommodating cover 30 is used for preventing rise of the temperature, which results from the heat generated by friction between air and the uneven rotor assembly 2, and reducing noise such as wind noise during rotation of the rotor assembly 2 in the centrifugal separation operation. It is important that the accommodating cover 30 has good thermal conductivity and high strength and is light in weight. Here, the accommodating cover 30 is made of a metal, such as an aluminum alloy. The base 32 having an annular shape is disposed on a lower opening part of the shell 31. The shell 31 and the base 32 form a bowl-shaped container. A circular through hole is formed in the center of the base 32. The coupling 36 is attached to the top of the through hole for fixing the rotor body 20.

A circular opening part 31*a* larger than the outer diameter of the rotor body 20 is formed on the upper side of the shell 31. The disk-shaped lid 33 is installed to the opening part 31*a* of the shell 31. A knob 34 is attached to the center of the lid 33, and a through hole is formed in the center of the knob 34. The upper front end part of a lock screw 35 can be inserted into the through hole to close the opening part 31*a* of the shell 31. Thereby, the lid 33 is only placed on top of the shell 31. The base 32 of the shell 31 and the coupling 36 can be fixed by a screw to move the accommodating cover 30 and the rotor body 20 together. After a fitting hole 36*a* formed in the coupling 36 is set on the crown 7*b* of the centrifuge 1 (see FIG. 1), a screw part 35*a* of the lock screw 35 rotatably attached to the rotor body 20 is screwed into a screw part 36*b* disposed on the crown 7*b*, so as to fix the rotor assembly 2 to the centrifuge 1.

Figure 3:
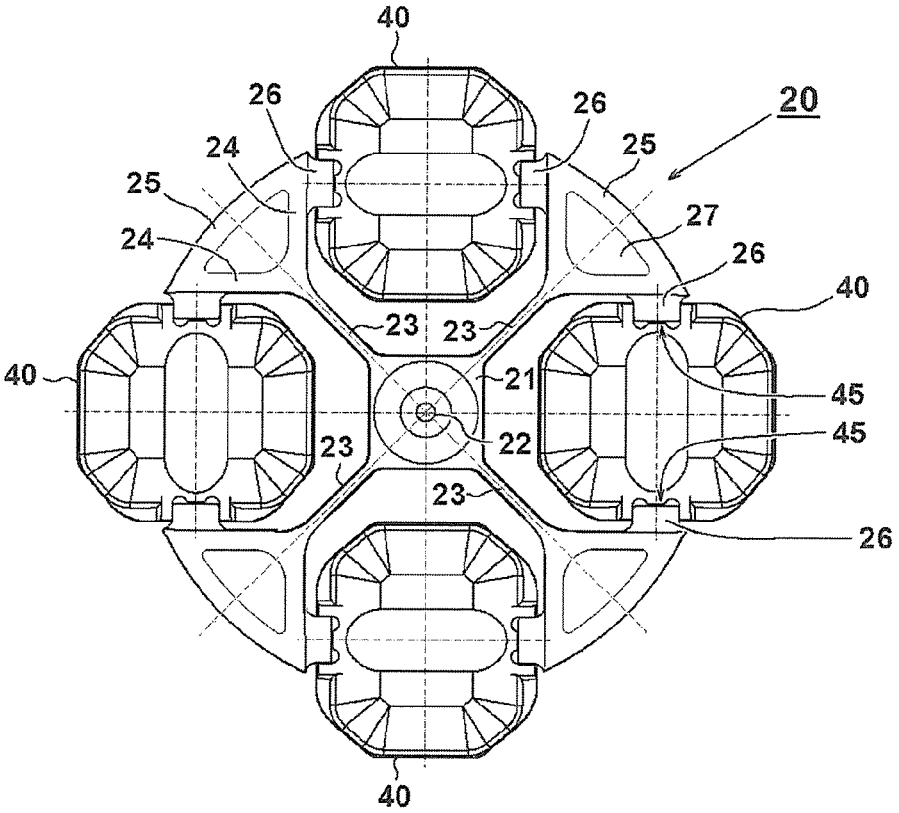
FIG. 3 is a bottom view of the rotor body 20 and the buckets 40 of the centrifuge 1 according to an embodiment of the invention.

Next, a detailed structure of the swing rotor (the rotor body 20 and the buckets 40) is described with reference to FIG. 3. FIG. 3 is a bottom view of the rotor body 20 and the buckets 40 of the centrifuge 1 according to an embodiment of the invention (the coupling 36 is not shown here). The rotor body 20 includes a hub 21, arm parts 23, and a bucket holding part. The hub 21 is formed with a through hole 22 and has a substantially rectangular parallelepiped outer shape. The arm parts 23 are on the outer side of the hub 21 in the radial direction and extend in four directions in a cross shape when viewed from above. The bucket holding part whose outer shape is substantially fan-shaped in the top view is respectively formed at the front end portion of the aim part 23. The hub 21 is a portion disposed on the coupling 36. If the number of the attached buckets 40 is four, four arm parts 23 are equally spaced at an interval of a rotation angle of 90° around the rotation axis (rotation center) of the hub 21. The bucket holding part includes two branch aims 24 and a connection arm 25. The two branch arms 24 are connected to spread outward in a V shape in the radial direction from the arm part 23. The connection arm 25 serves as a connection part connecting ends of the adjacent branch arms 24 in an arc shape. A through thickness-reduced part 27 is foamed between the two branch arms 24 and the connection arm 25. The rotor body 20 is mainly manufactured by precision casting of stainless cast steel or an aluminum alloy. Only the portions that require combining accuracy are formed integrally by cutting using machining. The through thickness-reduced part 27 is an opening portion penetrating in the axial direction of the rotation axis of the rotor. Here, the outer shape of the through thickness-reduced part 27 in the top view is made similar to the outer shape of the substantially fan-shaped bucket holding part (the outer edge shape of the two branch arms 24 and the connection arm 25).

In terms of the positional relationship of the branch aims 24, the branch arms 24 extend in a direction perpendicular to the rotation axis, and the branch arms 24 that face each other with the bucket 40 sandwiched therebetween are parallel to each other. The concave parts of the bucket 40 are hung on the holding pins 26 of these parallel branch arms 24, so as to hold one bucket 40 in a swingable manner. The holding pin 26 is formed on each of the branch arms 24 separated by the through thickness-reduced part 27. The holding pin 26 has a substantially cylindrical shape for supporting the bucket 40 and protrudes in a convex shape toward the side of the bucket 40. The extending direction of the holding pin 26 (the axial direction of the holding pin 26) is the same as a tangential direction of a rotation trajectory of the rotor body 20. A concave depression (orthogonal plane 45 and so on) is formed on the bucket 40. In addition, the number of the arm parts 23, the interval (rotation angle) of the arm parts 23, and the angle between two branch arms 24 at the front end of the arm part 23 on the outer peripheral side can be set at will according to the number of the buckets 40 to be attached.

Figure 4:
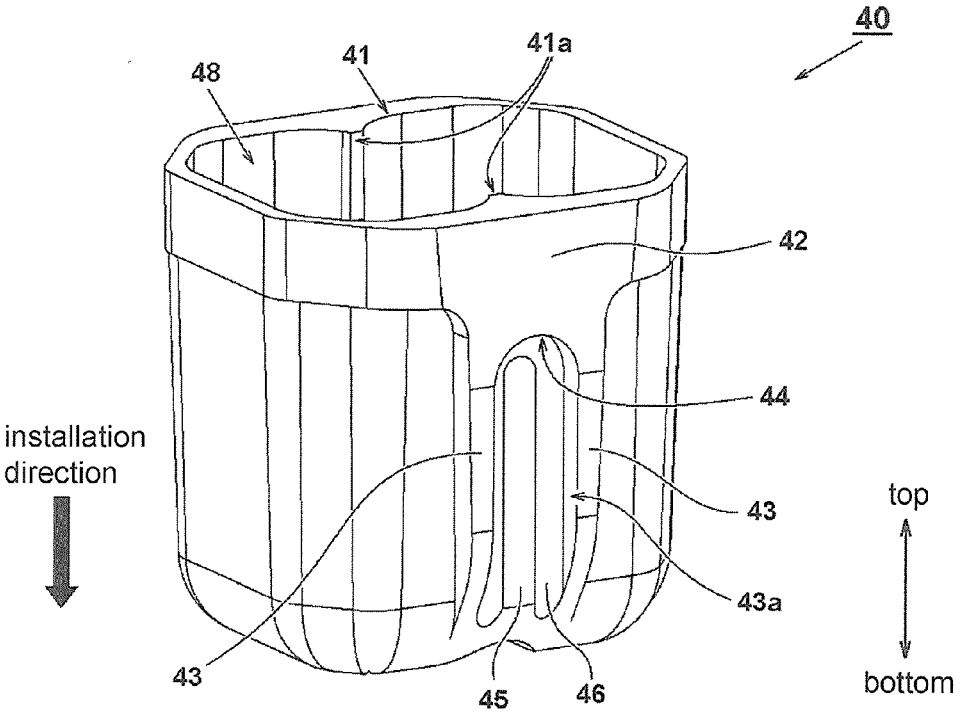
FIG. 4 is a perspective view of the bucket 40 of FIG. 1.

FIG. 4 is a perspective view of the bucket 40 used in the centrifuge 1 of this embodiment. The bucket 40 is detachable from the rotor body 20. By moving the bucket 40 downward from the top (installation direction: the downward direction parallel to the axial direction), the bucket 40 can be installed to the rotor body 20. The bucket 40 has an opening part 41 on the top. Two protrusion parts 41*a* are formed opposite to each other on the inner side of the bucket 40. An inner space 48 for accommodating the sample container 50 is formed downward from the opening part 41. In this embodiment, the opening part 41 of the bucket 40 is in an open state. However, an openable lid may be formed on the opening part 41. The bucket 40 is manufactured by integrally molding a metal such as an aluminum alloy, for example. The bucket 40 has a cup shape that has the substantially rectangular opening part 41 when viewed from above. A thick part 42 where the thickness is partially increased is formed around the opening part 41. The bucket 40 of this embodiment has a shape that the inner space 48 is divided into two parts.

A concave part is formed on a side surface of the long side of the bucket 40. The concave part is sandwiched by the thick part 42 and two guide ribs 43 that extend downward from the thick part 42. The concave part is a recess when viewed from the outer side in the axial direction of the swing axis of the bucket. A width of the concave part is slightly larger than the diameter of the holding pin 26, so as to guide the holding pin 26. A main purpose of the guide ribs 43 is to Run a guide surface 43*a* for guiding the holding pin 26. Formation of the guide ribs 43 can significantly improve the rigidity of the bucket 40. In this embodiment, a continuous groove 46 having an inverted U shape in the side view is formed in a region (bottom portion in terms of the concave part) orthogonal to the swing axis to face the front end side of a cylindrical surface of a pin receiving part 44. The orthogonal plane 45, which is a flat surface portion orthogonal to the swing axis, is formed on the inner side portion of the inverted U-shaped groove 46.

Figure 5:
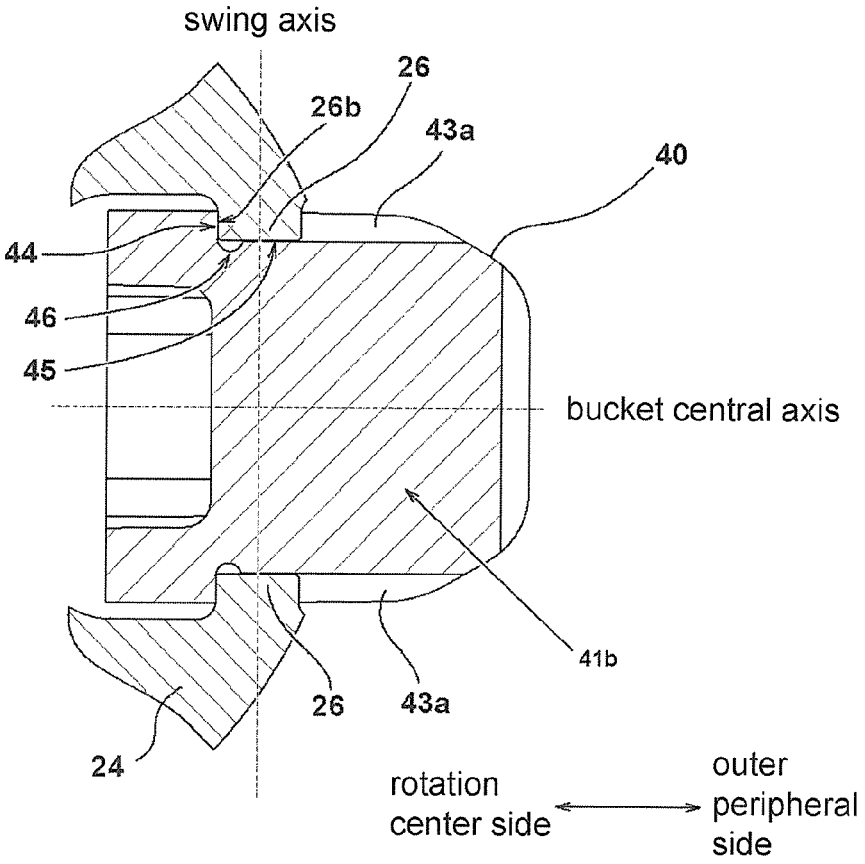
FIG. 5 is a transverse cross-sectional view of the rotor of the centrifuge 1 during high-speed rotation according to an embodiment of the invention.

FIG. 5 is a transverse cross-sectional view of the rotor of the centrifuge 1 during high-speed rotation according to an embodiment of the invention. This cross-section is taken along a plane that passes through the central axis (swing axis) of the holding pin 26 and the central axis of the bucket 40 when the bucket 40 is swung horizontally during high-speed rotation of the rotor body 20. The bucket 40 is swingably supported while sliding along the pin receiving part 44 of the holding pin 26. The pin receiving part 44 is in contact with the cylindrical surface 26*b* of the holding pin 26, so as to support the centrifugal load of the bucket 40. In addition, a plate-shaped bucket partition plate 41*b* is disposed from the upper side to the lower end of the swing axis of the bucket 40 and the rigidity of the bucket 40 is enhanced. At the moment, a strong force is applied to the holding pin 26 toward the outer peripheral side. In a portion adjacent to the contact surface of the holding pin 26 and the bucket 40, the groove 46 is formed. The groove 46 is formed on the bucket 40 and recessed towards the axial central side of the swing axis of the contact surface (half of a cylindrical shape). The orthogonal plane 45 of the bucket 40 faces the holding pin 26 with a small distance therebetween in the swing axis of the holding pin 26 or is in contact with the holding pin 26.

Figure 9:
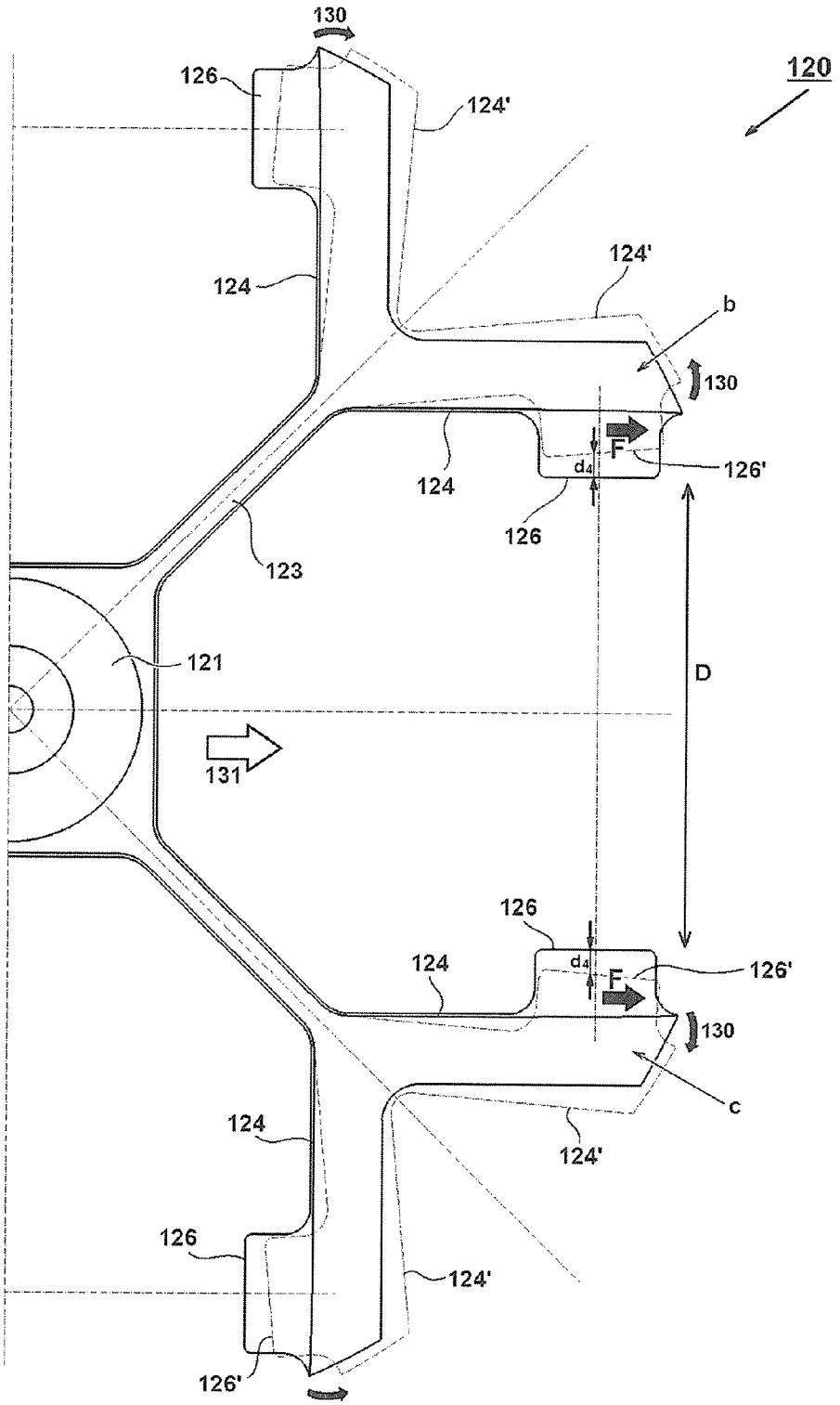
FIG. 9(RELATED ART)
FIG. 9 is a partial plan view of the bucket holding part of the rotor body 120 in the conventional centrifuge, in which the dotted lines indicate the deformation state in the centrifugal separation operation exaggeratedly.

Next, before describing the rotor body 20 of the centrifuge 1 of this embodiment, the shapes of the conventional rotor bodies are described with reference to FIG. 9 to FIG. 11, so as to make this embodiment more understandable. FIG. 9 is a plan view of (only half of) a rotor body 120 of the conventional centrifuge, in which the solid lines indicate the state when the rotation of the rotor stops and the dotted lines indicate the deformation state in the centrifugal separation operation. The conventional rotor body 120 includes an arm part 123 and two branch arms 124, wherein the arm part 123 extends outward in a cross shape in the radial direction of a hub 121, and the two branch arms 124 extend in a V shape respectively from the front end portion of the arm part 123. A holding pin 126 is formed on the branch arm 124. Here, the bucket holding part includes only two straight lines (branch arms 124) and the holding pin 126. In this case, when the holding pin 126 is deformed by the centrifugal load F of the bucket 40 and the sample, the branch arm 124 deforms according to the strength of this part.

The holding pins 126 that extend coaxially are formed respectively on the branch arm 124 indicated by the arrow b and the branch aim 124 indicated by the arrow c opposite thereto. A distance D between this set of holding pins 126 is set corresponding to the size of the bucket 40 to be installed. The space (bucket accommodating part) between the holding pin 126 on the side of the arrow b and the holding pin 126 on the side of the arrow c is an open structure that does not have a connection part on the outer peripheral side. In the rotor body 120 having this configuration, when the rotor rotates at a high speed to swing the bucket 40, the centrifugal load F is applied on the holding pins 126 toward the outer peripheral side. Consequently, the branch arms 124 are deformed by the centrifugal load F, as indicated by the arrow 130, and the positions of the branch arms 124 and the holding pins 126 are deformed from the state indicated by the solid lines to the state indicated the dotted lines (branch arms 124' and holding pins 126). Besides, it should be noted that the deformation amount is exaggerated in the figure to make the deformation state more understandable, and deformation of the arm part 123 and so on outward in the radial direction is not taken into consideration. Due to the deformation, the holding pins 126 shift to the positions of 126'. Therefore, in the circumferential direction, the holding pins 126 deform for only a distance $d_4$ in the swing axis (although the distance $d_4$ shown in FIG. 9 deviates from the swing axis, it is located on the axis). When the branch arms 124 deform as shown by 124' described above, the distance between the opposite holding pins 126 viewed in the direction of the swing axis extends from D to $D+2d_4$, which is unfavorable for stability of holding of the bucket 40. In addition, the deformation reduces the contact area between the cylindrical surface of the holding pin 126 and the pin receiving part 44 of the bucket 40, which increases the centrifugal load applied on a portion of the holding pin 126 and leads to reduction of the lifespan. To cope with this problem, it is considered to use a reinforcing member to connect between the branch arms 124 indicated by the arrows b and c, i.e. in the outer peripheral portion of the bucket 40, so as to fix the branch arms 124 indicated by the arrows b and c. However, disposing such a connection member is a factor that will increase the size of the external shape of the rotor body 120 and limit the swing range of the bucket 40. Thus, it is unfavorable. Therefore, for the rotor body 120, it is important that the structure has no connection member in the bucket accommodating part where the bucket 40 swings, i.e. the open structure with no member therein when viewed on the outer peripheral side as indicated by the arrow 131 of FIG. 9.

Figure 10:
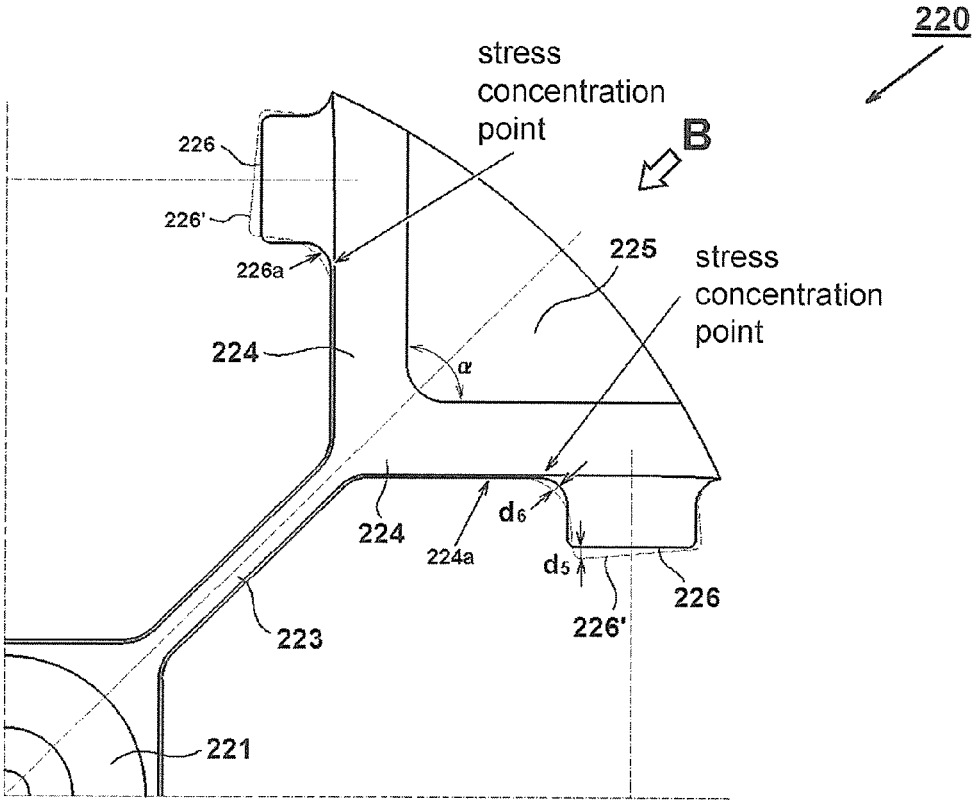
FIG. 10(RELATED ART)
FIG. 10 is a partial plan view of the bucket holding part of the rotor body 220 in another conventional centrifuge.
Figure 11:
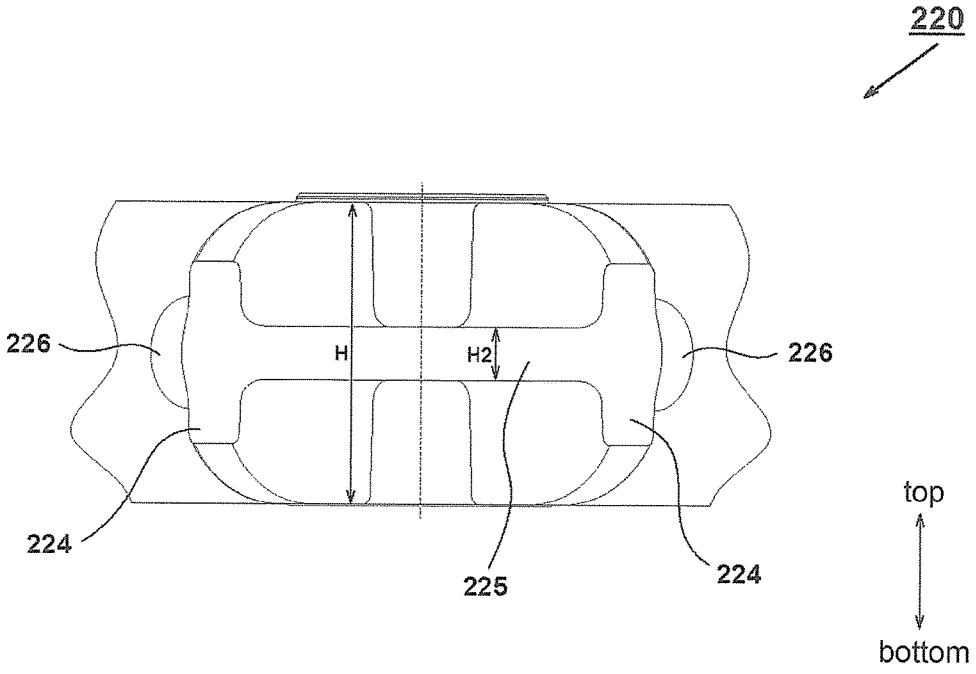
FIG. 11(RELATED ART)
FIG. 11 is an arrow view from the direction B of the rotor body of FIG. 10.

A rotor body 220 as shown in FIG. 10 and FIG. 11 is made as an improvement to the shape of FIG. 9. An arm part 223 and branch arms 224 of the rotor body 220 are substantially the same as those of the rotor body 120 of FIG. 9 in shape. The arm part 223 extends outward in the radial direction of a hub 221. A holding pin 226 is formed integrally with the branch arm 224, which is also the same as the rotor body 120 of FIG. 9. However, the rotor body 220 has a structure that the adjacent branch arms 224 are connected by a flat plate-shaped reinforcing rib 225 which extends in an arc shape. FIG. 11 is an arrow view showing the rotor body 220 from the direction of the arrow B of FIG. 10. As can be understood from FIG. 11, the reinforcing rib 225 has a height H2 which is sufficiently small compared to the height H near the inner peripheral end of the branch arm 224, and the reinforcing rib 225 is formed at the same position as the attachment position of the holding pin 226 when viewed in the vertical direction. The reason is that if the reinforcing rib 225 is thickened, the weight of the rotor body 220 increases. By disposing the reinforcing rib 225 as described above, it is possible to prevent the branch arms 224 from deforming and avoid deformation that reduces an intersection angle $\alpha$ of the branch arms 224 (see FIG. 10). The deformation condition at the moment is indicated by the dotted lines of FIG. 10. The holding pin 226 deforms as indicated by the dotted lines 226' corresponding to the deformation of the branch arm 224 to sustain the centrifugal load. Therefore, the portion near the base of the branch arm 224 deforms as indicated by $d_6$ and the front end side of the front end surface (the surface facing the bucket 40) of the branch arm 224 deforms to only $d_5$ at most.

The deformation amount of the rotor body 120 of FIG. 9 is large compared to that of the rotor body 220 shown in FIG. 10, but on the other hand, the stress concentration near the base of the holding pin 126 is low. However, since there is no such reinforcing rib 225 between the pair of opposite holding pins 126, the deformation amount $d_4$ increases. As a result, the relative gap with respect to the bucket 40 increases, and the imbalance caused by the gap worsens and may result in abnormal vibration during the rotation. On the other hand, in the rotor body 220 shown in FIG. 10, the deformation amount of the branch arm 224 is small and the deformation amount $d_5$ at the front end side of the holding pin is small. However, if the deformation of the branch arm 224 is hindered, a strong stress will be concentrated on the connection portion of the branch arm 224 and the holding pin 226, especially, near an inflection point of an arc surface **226*a* and a planar part 224*a* that are formed to smoothly connect from the branch arm 224 to the holding pin 226 and to alleviate the stress (near the "stress concentration point" of FIG. 10**).

Figure 6:
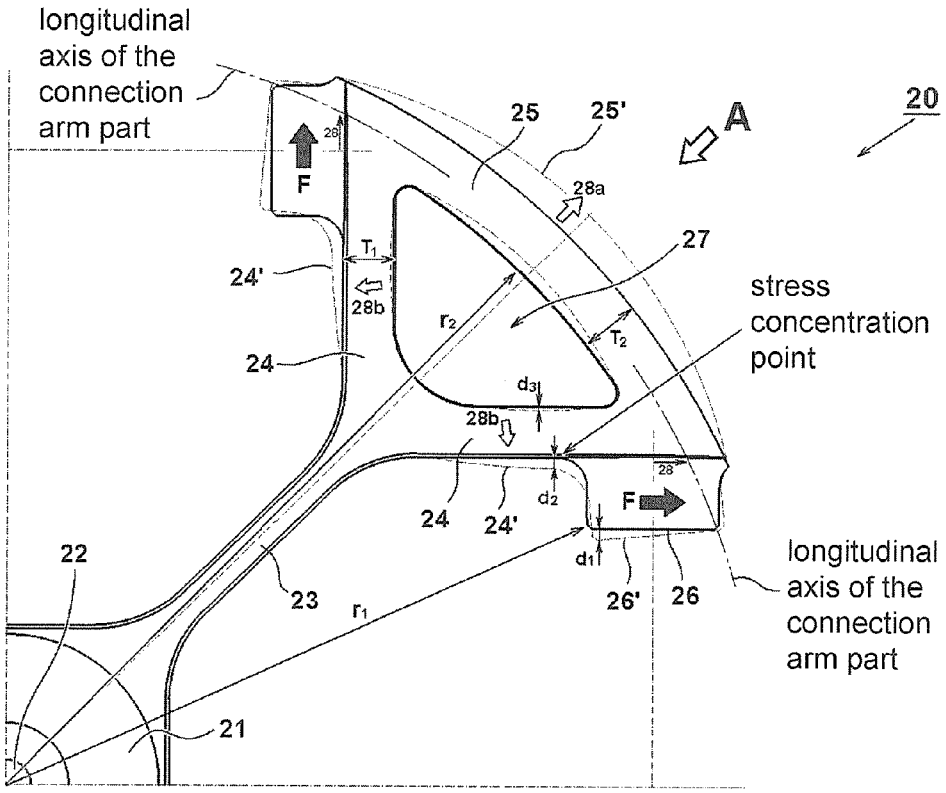
FIG. 6 is a partial plan view of the bucket holding part of the rotor body 20 in an embodiment of the invention, in which the dotted lines indicate the deformation state in the centrifugal separation operation exaggeratedly.

Therefore, the invention is made. FIG. 6 is a partial plan view (solid lines) of the front end part of the rotor body 20 in an embodiment of the invention. In FIG. 6, the bucket holding part is formed on the front end side (the outer side in the radial direction) of the arm part 23. The bucket holding part includes two branch arms 24, an arc-shaped connection arm 25, and holding pins 26. The two branch arms 24 part and diverge from the front end of the arm part 23. The connection arm 25 connects the ends of the branch arms 24 on the outer peripheral side. The holding pins 26 respectively extend from the two branch arms 24. A through thickness-reduced part 27 is formed in the bucket holding part so as to reduce the weight and make the branch arms 24 and the holding pins 26 deform in a controlled shape. By disposing the through thickness-reduced part 27, the configuration is divided into the arc or bow portion of the bucket holding part (connection arm 25) and two straight portions of a substantially fan shape (two branch arms 24). The arm parts 23 are arranged on the rotor body 20 at an equal interval of 90 degrees, and the bucket holding part being substantially fan-shaped in the top view is connected to the front end portion of the arm part 23. The longitudinal axis of the connection arm 25 may be disposed to pass through the outer peripheral side with respect to an intersection of the outer peripheral surface of the branch aims 24 and the central axis of the holding pins 26, as indicated by the arrow 28. In addition, a minimum distance $r_2$ from the rotation center of the swing type rotor body 20 of the connection arm 25 to the connection arm 25 is set equal to or greater than a minimum distance $r_1$ from the rotation center of the swing rotor body to the cylindrical surface of the holding pin 26. When such a bucket holding part is formed and the bucket 40 is rotated at a high speed, the centrifugal load F of the bucket 40, the sample container 50, and the sample 55 is applied on the holding pin 26, and further a centrifugal force is applied due to the weight of the rotor body 20.

When the holding pin 26 is deformed by the centrifugal load F of the bucket 40 and the sample, the branch arms 24, i.e. the two straight portions of the substantially fan-shaped bucket holding part, deform according to the strength of this part. That is, the branch arms 24, the connection arm 25, and the holding pins 26 of the bucket holding part deform from the state of the solid lines to the state of the broken lines (deformed branch arms 24', deformed connection arm 25', and deformed holding pins 26') through forces as indicated by the arrow **28*a* and the arrow 28*b*. Moreover, it should be noted that the deformation amount is exaggerated in FIG. 6 to make the invention more understandable, and the deformation amount of the hub 21 or the arm part 23 is ignored. Here, like the conventional example illustrated in FIG. 10, the holding pin 26 is distorted in a way that mainly the inner peripheral side deforms only for the distance $d_1$, as indicated by the dotted lines, due to the centrifugal load F, and a strong stress corresponding to the deformation is applied at the stress concentration point. Since the through thickness-reduced part 27 penetrating in the same direction as the rotation axis of the rotor body is formed in the center of the bucket holding part, a force as indicated by the arrow 28*b* is generated on the branch arm 24. Therefore, the branch arm 24 near the stress concentration point deforms slightly larger as indicated by $d_2$ and the branch arm 24 on the side of the through thickness-reduced part 27 deforms as indicated by $d_3$. The configuration of this embodiment allows the deformation of $d_2$ and $d_3$, so as to prevent the stress from being excessively concentrated at the stress concentration point. Therefore, in the substantially fan-shaped opposite side portions (branch arms 24) of the bucket holding part, deformation of the desired positions (the inner peripheral side slightly inward with respect to the stress concentration point) is allowed. Here, referring to the conventional example of FIG. 10, the substantially fan-shaped opposite side portions (branch arms 24) of the bucket holding part have very little deformation amount (deformation corresponding to $d_2$ and $d_3$ of FIG. 6) because of the reinforcing rib 225. Thus, only the holding pin 26 deforms and causes the stress at the stress concentration point to increase. With the configuration of this embodiment, the centrifugal load can be sustained not only by the holding pin 26 but also by the branch arm 24, and therefore, by properly adjusting the thickness (wall thickness) and position of the arc or bow portion (connection arm 25) in the radial direction, the relative gap between the holding pin 26 and the bucket 40 can be suppressed to the minimum and the swing rotor for the centrifuge can lower the stress concentration and reduce the imbalance caused by the gap and have a long lifespan. Here, a circumferential thickness $T_1$ of the branch arm 24 may be smaller than a radial thickness $T_2$ of the connection arm 25**, i.e. the connection part.

Figure 7:
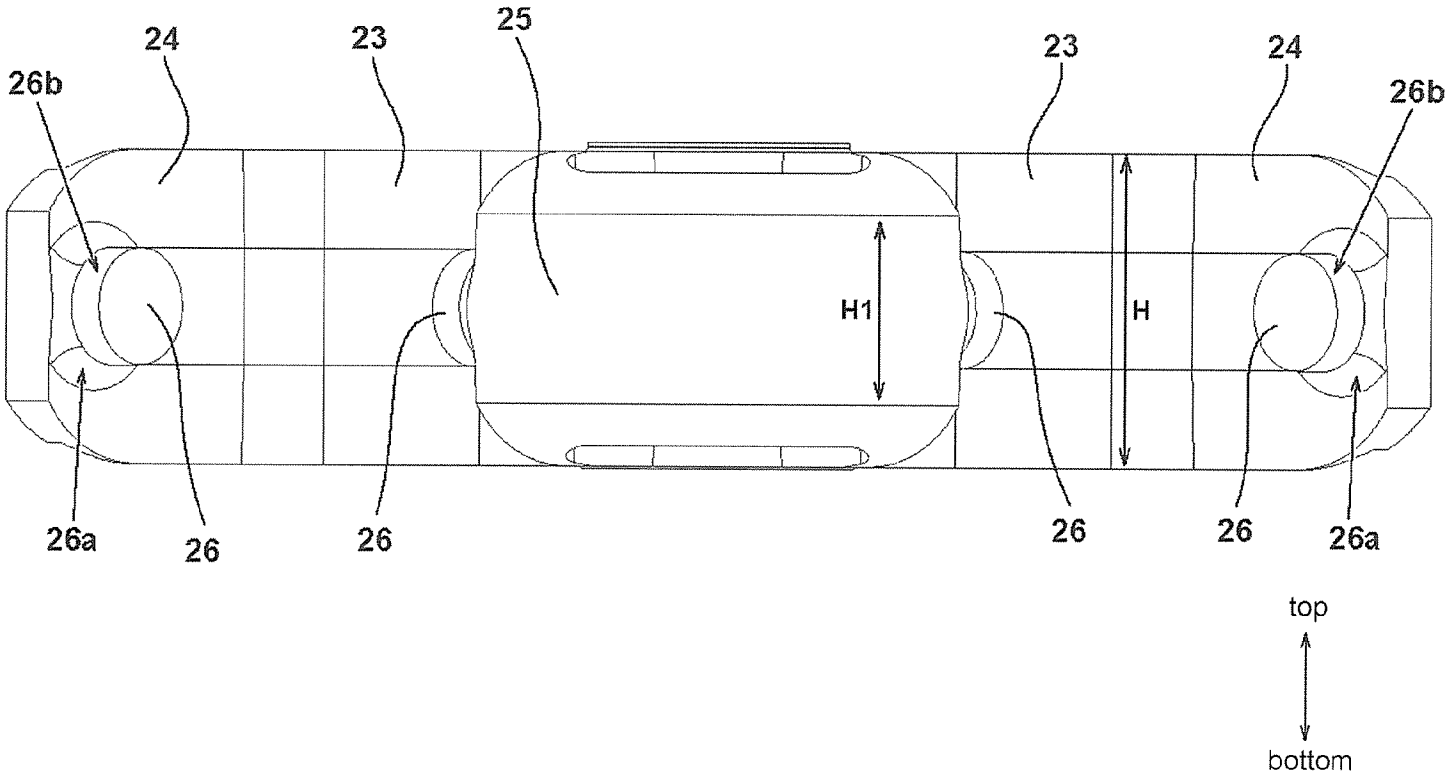
FIG. 7 is an arrow view from the direction A of the rotor body 20 in an embodiment of the invention.

FIG. 7 is an arrow view from the direction A of the rotor body 20 in an embodiment of the invention. Specifically, the direction A is the arrow A shown in FIG. 6. As known from this figure, a height H1 of the connection arm 25 is smaller than a height H of the arm part 23 but is substantially equal to a height of the narrowed front end portion of the branch arm 24. By such formation, the portion from the upper end to the lower end of the outer peripheral portion of the branch arm 24, which is formed thinner than a radial thickness $T_2$ of the connection arm 25 (see FIG. 6), can be held. Thus, the overall deformation of the branch arm 24 (the deformation as shown in FIG. 9) can be suppressed effectively. Further, in FIG. 7, it can be understood that the holding pin 26 is a protrusion formed integrally with the rotor body 20 and has a cylindrical surface 26*b*, and boundary portions of the branch arm 24 and the holding pin 26 are connected by a curved arc surface 26*a*.

Embodiment 2

Figure 8:
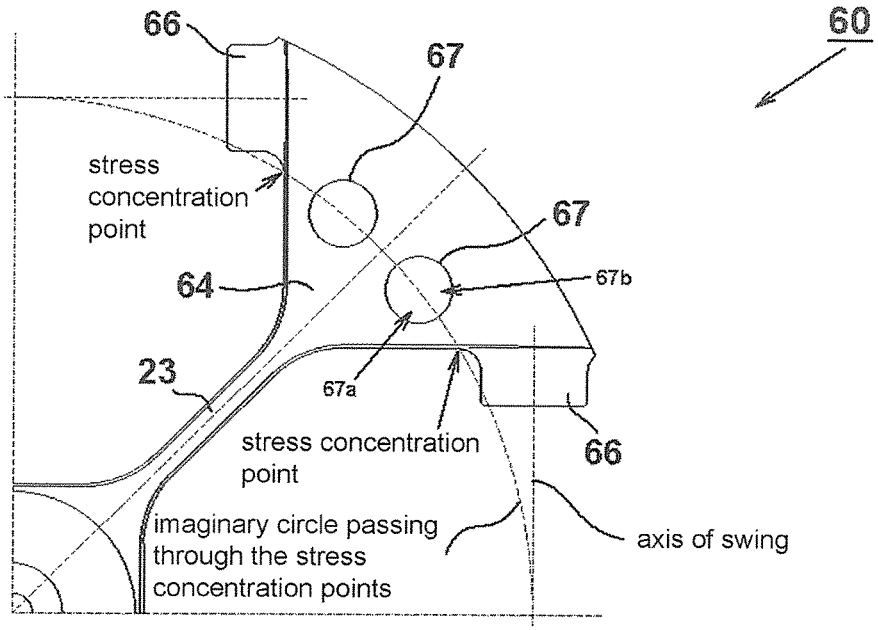
FIG. 8(1), FIG. 8(2), and FIG. 8(3) are partial plan views of the bucket holding part of the rotor body in the second to fourth embodiments of the invention.
Figure 8:
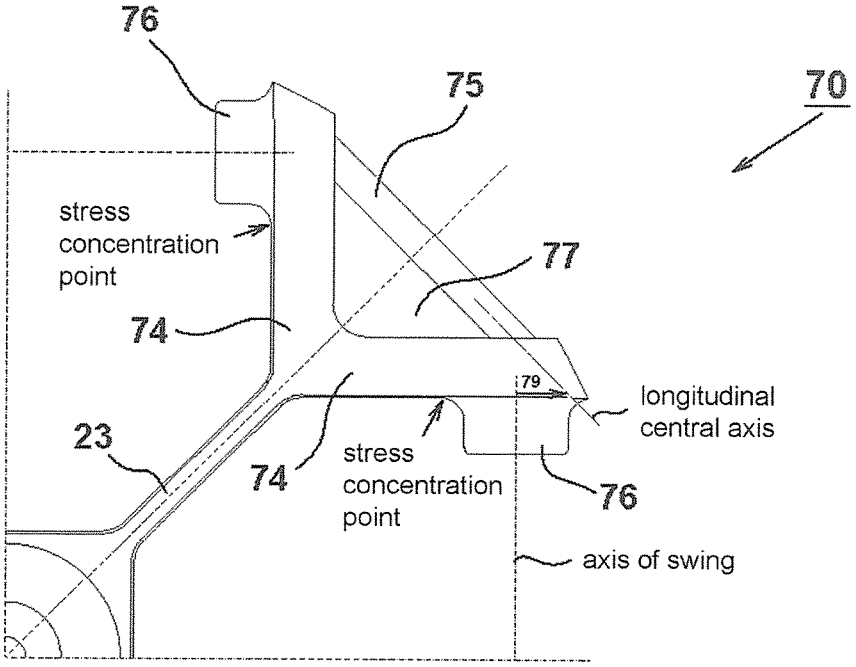
Figure 8:
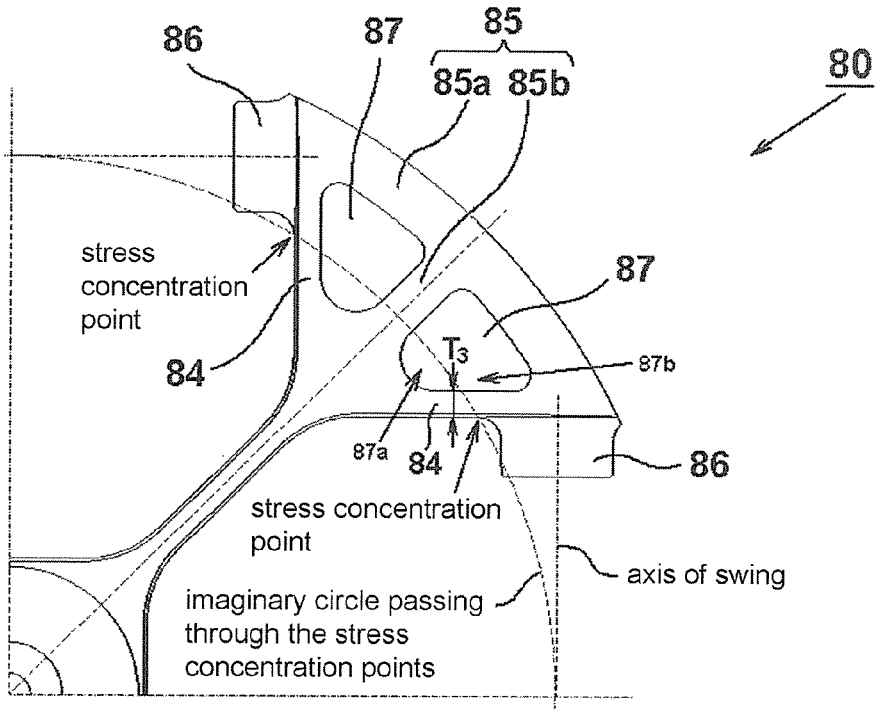

The second embodiment of the invention is described below. In the first embodiment described above, the through thickness-reduced part 27 has a shape similar to the outer edge shape of the branch arms 24 and the connection part 25 in the top view. In the second embodiment, however, the thickness-reduced part is formed in a shape not similar to the outer edge shape of the branch arms and the connection part. FIG. 8(1) is a partial plan view of the bucket holding part of a rotor body 60 in the second embodiment of the invention. The arm parts 23 are arranged on the rotor body 60 at an equal interval to extend outward in the radial direction, and a bucket holding part 64 being substantially fan-shaped is formed on the front end portion of the arm part 23. The bucket holding part 64 has a structure that is made by integrally forming the connection portion with the branch arms, which form two straight portions in a substantially fan shape or opposite side portions in a substantially triangular shape. Two through holes 67 that are circular in the top view are formed near the center of the bucket holding part 64 to penetrate in the axial direction of the rotor. Instead of disposing the through hole 67 at a random position, it is particularly preferable to form the center of the through hole 67 on an imaginary circle, so as to overlap the imaginary circle that passes through the stress concentration points (the center coincides with the center of the rotor body 60). In this way, an inner peripheral portion 67*a* and an outer peripheral portion 67*b* with respect to the imaginary circle that passes through the stress concentration points exist in the through holes 67. By such formation, the portion of the bucket holding part 64 on the outer peripheral side of the through holes 67 has the same function as the connection arm and thus can effectively prevent the V-shaped branch arm portions from deforming close to each other (deformation that reduces the intersection angle a when compared with FIG. 10). Further, since the portion of the branch arm near the stress concentration point is allowed to deform slightly, the stress near the base of the holding pin 66 (particularly, the stress concentration point) can be reduced. Because it is easy to perform the cutting work for opening the through holes 67, the configuration of this embodiment can suppress increase of the manufacturing costs of the rotor body 60.

Embodiment 3

FIG. 8(2) is a partial plan view of the bucket holding part of a rotor body 70 in the third embodiment of the invention. The arm parts 23 are arranged on the rotor body 70 at an equal interval to extend outward in the radial direction, and a bucket holding part being substantially triangular is formed on the front end portion of the arm part 23. The bucket holding part includes two branch arms 74, holding pins 76, and a rod-shaped connection arm 75. The two branch arms 74 diverge in a V shape from the front end of the arm part 23. The holding pin 76 is formed integrally with the branch arm 74. The connection arm 75 connects the front end sides of the two branch arms 74. The connection arm 75 may be shaped like a round bar or a square bar. The connection arm 75 may be formed integrally with the branch arms 74 or individually. Here, the attachment position of the connection arm 75 is set such that the longitudinal axis of the connection arm 75 is located on the outer side in the radial direction to the extent indicated by the arrow 79 with respect to the intersection point of the central axis of the holding pin 76 and the surface of the branch arm 74 on the bucket side. By such formation, since the through thickness-reduced part 77 is formed and the portion of the branch arm 74 near the stress concentration point is allowed to deform like the first embodiment, the stress near the base of the holding pin 76 (particularly, the stress concentration point) can be reduced.

Embodiment 4

FIG. 8(3) is a partial plan view of the bucket holding part of a rotor body 80 in the fourth embodiment of the invention. Instead of forming the large through thickness-reduced part 27 (see FIG. 6) like the first embodiment, in the fourth embodiment, the through thickness-reduced part has a shape that the portions near the middle in the circumferential direction are connected in the radial direction. Thus, a connection part 85 is formed by a circumferential connection arm 85*a* and a radial connection arm 85*b*. Consequently, two through thickness-reduced parts 87 are formed. Here, the through thickness-reduced parts 87 may be disposed to overlap the imaginary circle (the center coincides with the center of the rotor body 60) that passes through the stress concentration points. The position or shape is set such that an inner peripheral portion 87*a* and an outer peripheral portion 87*b* with respect to the imaginary circle passing through the stress concentration points exist in the through thickness-reduced part 87. In the fourth embodiment, due to formation of the radial connection arm 85*b*, the weight of the bucket holding part increases compared to the first embodiment. However, the thickness $T_3$ of the branch arm 84 at the stress concentration point is reduced correspondingly. By such formation, since the portion of the branch arm 84 near the stress concentration point is allowed to deform properly like the first embodiment, the stress near the base of the holding pin 86 (particularly, the stress concentration point) can be reduced.

As described above, according to this embodiment, the bucket holding part of the rotor body is formed with the through thickness-reduced part without using expensive materials and the portion of the branch arm to which the holding pin is attached is configured to deform easily. Thus, the deformation amount of the opposite side portions of the bucket holding part can be properly adjusted to reduce stress concentration near the base of the holding pin, reduce the imbalance caused by the gap between the holding pin and the bucket, and achieve the centrifuge and the swing rotor for the centrifuge with long lifespan. Although the invention has been described above based on the embodiments, the invention should not be construed as limited to the aforementioned embodiments, and various modifications may be made without departing from the spirit of the invention.

What is claimed is:

1. A swing rotor for a centrifuge, comprising:

a plurality of holding pins disposed on a swing type rotor body; and a plurality of buckets hung on the holding pins in a swingable manner, wherein the rotor body comprises a plurality of arm parts extending outward in a radial direction from a rotation center and a plurality of branch arms diverging at a front end of each of the arm parts on an outer peripheral side to be separated by a predetermined angle, and the holding pins are fixed to the branch arms, wherein a connection part is configured to connect two of the branch arms diverging from the arm parts on the outer peripheral side, and a thickness-reduced part penetrating in a same direction as a rotation axis of the rotor body is configured in a region surrounded by the two branch arms on an inner peripheral side of the connection part, wherein a circumferential thickness of one of the branch arms connected to the connection part is smaller than a radial thickness of the connection part, and the holding pins are protrusions formed integrally with the rotor body and each comprise a cylindrical surface, and boundary portions between the branch arms and the holding pins are connected by curved surfaces including convex base parts, such that during a centrifugal separation operation the branch arms deform in a state substantially perpendicular to the holding pins, such that stress concentrations near the convex base parts of the holding pins are alleviated.

2. The swing rotor for the centrifuge according to claim 1, wherein a space between a set of the holding pins formed on the branch arms that extend from two adjacent aim parts of the a parts to face the held bucket is an open structure without the connection part on the outer peripheral side.

3. The swing rotor for the centrifuge according to claim 2, wherein the connection part has a columnar shape and is disposed such that a longitudinal axis of the connection part is located on an outer side in the radial direction with respect to an intersection point of a central axis of one of the holding pins and one of the branch arms connected to the one of the holding pins.

4. The swing rotor for the centrifuge according to claim 3, wherein the thickness-reduced part has a shape similar to an outer edge shape of the branch arms and the connection part when viewed from above.

5. A centrifuge, comprising a driving shaft rotated by a driving device and a swing type rotor body installed on the driving shaft, wherein:

the rotor body is the rotor body according to claim 4.

6. The swing rotor for the centrifuge according to claim 3, wherein the thickness-reduced part has a shape not similar to the outer edge shape of the branch arms and the connection part when viewed from above.

7. A centrifuge, comprising a driving shaft rotated by a driving device and a swing type rotor body installed on the driving shaft, wherein:

the rotor body is the rotor body according to claim 3.

8. A centrifuge, comprising a driving shaft rotated by a driving device and a swing type rotor body installed on the driving shaft, wherein:

the rotor body is the rotor body according to claim 2.

9. The swing rotor for the centrifuge according to claim 1, wherein a minimum distance from the rotation center of the rotor body to the connection part is equal to or greater than a minimum distance from the rotation center of the rotor body to the cylindrical surface of each of the holding pins.

10. A centrifuge, comprising a driving shaft rotated by a driving device and a swing type rotor body installed on the driving shaft, wherein:

the rotor body is the rotor body according to claim 1.

* * * * *